US006237881B1

(12) United States Patent
Levesque

(10) Patent No.: US 6,237,881 B1
(45) Date of Patent: May 29, 2001

(54) CONVERTIBLE TABLE AND FLOWER POT HOLDER

(76) Inventor: Micheline Levesque, 215 Grande Allée, Terrebonne, Québec (CA), J6W 4S2

( * ) Notice: Subject to any disclaimer, the term of this patent is extended or adjusted under 35 U.S.C. 154(b) by 0 days.

(21) Appl. No.: 09/356,353

(22) Filed: Jul. 16, 1999

Related U.S. Application Data

(60) Provisional application No. 60/093,411, filed on Jul. 20, 1998.

(51) Int. Cl.[7] ..... A47G 23/02

(52) U.S. Cl. ..... 248/146; 248/156; 108/157.1

(58) Field of Search ..... 248/311.2, 150, 248/146, 151, 156, 312.1, 163.1, 165; 108/11, 14, 158.12, 157.1, 157.16, 157.15, 146, 150; 47/39, 41.01

(56) References Cited

U.S. PATENT DOCUMENTS 1,806,123 * 5/1931 Smith ..... 47/39
2,360,420 * 10/1944 Hill ..... 248/156
2,861,764 * 11/1958 Fisher ..... 248/146
3,648,659 * 3/1972 Jones ..... 248/158
4,266,748 * 5/1981 Dalton ..... 248/425
4,850,564 * 7/1989 Padin ..... 248/533
5,966,868 * 10/1999 Cox ..... 47/66.6

* cited by examiner

*Primary Examiner*—Anita M. King
*Assistant Examiner*—Gwendolyn Baxter
(74) *Attorney, Agent, or Firm*—Eric Fincham

(57) ABSTRACT

A convertible flower pot support and table which comprises a base and an upper support member with a plurality of legs extending between the base and the upper support member, the upper support member having a centrally located aperture designed to receive a flower pot or a table top which has a connecting ring extending downwardly from a bottom surface thereof, the connecting ring being designed to fit within the aperture of the upper support member. The device may be easily stored and in preferred embodiments, there is provided an anchoring peg for anchoring the same to the ground.

11 Claims, 2 Drawing Sheets

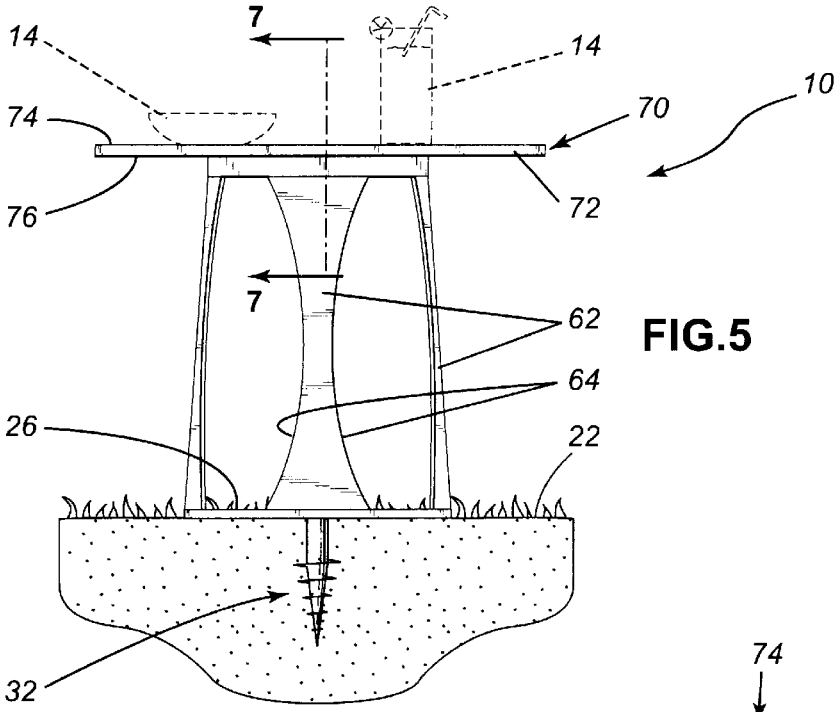
FIG.5
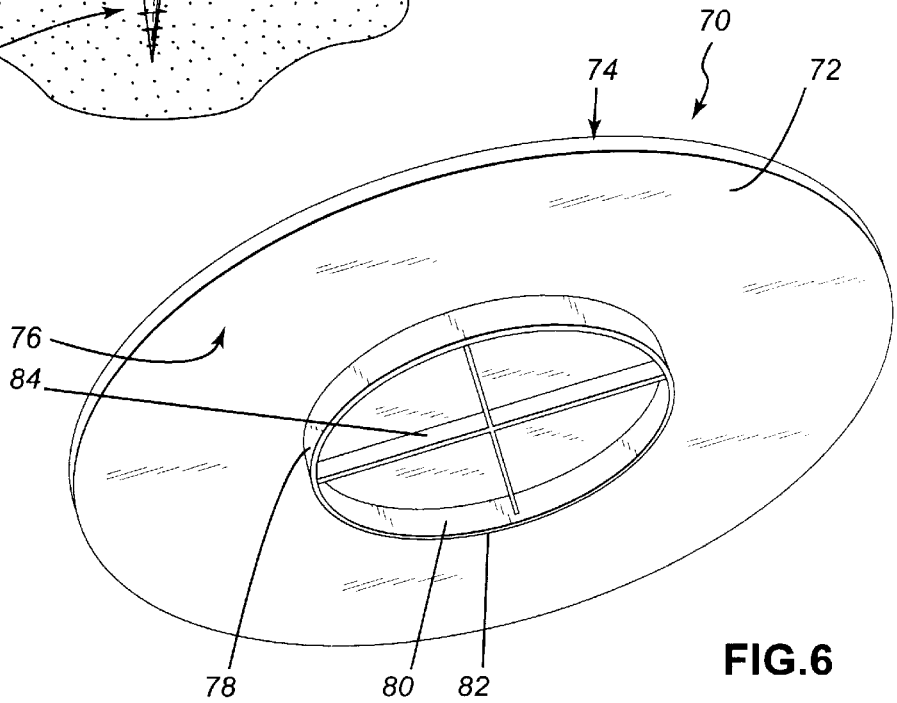
FIG.6
FIG.7
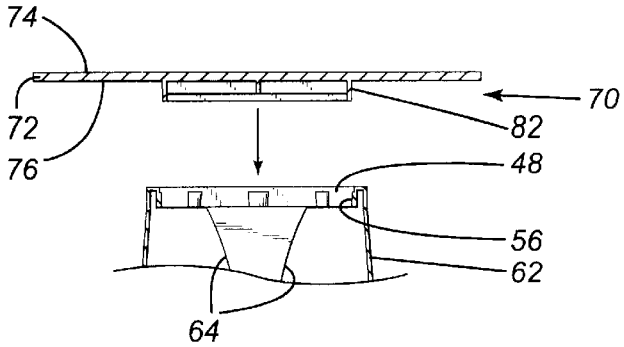

CONVERTIBLE TABLE AND FLOWER POT HOLDER

The present application claims priority on Provisional Application Ser. No. 60/093,411 filed Jul. 20, 1998.

The present invention relates to the field of garden utility articles and is particularly concerned with a convertible flower pot holder/garden table.

BACKGROUND OF THE INVENTION

Recent trends toward increased leisure activities has led to a concomitant increase in garden leisure activities. Two of the most popular garden activities include gardening per se, that is taking care of plants and using the garden as a setting for meals or other social gatherings.

The prior art is replete with various articles specifically designed to be used either as flower pot holders for supporting flower pots in a predetermined level above the ground surface and garden tables for allowing support of articles such as meal plates and the like. While the prior art plant supporting structures and tables are relatively effective in performing their respective tasks, to have both structures available means that two separate articles are required. The prior art has failed to show structures which could be used for selectively performing either a flower pot holding function or a conventional table function. Consequently, intended users must purchase both a flower pot holder and a garden table which leads to high purchase cost and a relatively large storage space. In certain geographic areas, gardens can only be accessed for leisure activities during a relatively short period of time. For example, in some northern regions, gardens are literally covered with ice and snow during the winter season and, consequently, garden articles such as flower pot holders and garden tables must be stored indoors in order to withdraw them from the detrimental effects of being exposed to cold temperature and snow during several months.

SUMMARY OF THE INVENTION

It is therefore an object of the present invention to provide a structure which may be readily converted from a flower pot configuration to a garden table configuration without requiring any special tooling or manual dexterity.

It is a further object of the present invention to provide a convertible flower pot support and table wherein the structure has an aesthetically pleasing configuration.

It is a further object of the present invention to provide a convertible flower pot support and table designed to accommodate flower pots of various sizes and configurations.

It is a still further object of the present invention to provide a convertible flower pot support and table which may be secured to the ground.

According to one aspect of the present invention, there is provided a convertible flower pot support and table comprising a base; an upper support member; at least one leg extending between the base and the upper support member; the upper support member having an aperture located therein, a wall surrounding the aperture; and a table top having an upper surface and a lower surface, a connecting ring extending downwardly from the bottom surface, the connecting ring being configured and sized to frictionally engage the wall surrounding the aperture to thereby retain the table top in position.

According to a further aspect of the present invention, there is provided, in combination, a structure comprising a base; an upper support member; a plurality of legs extending between the base and the upper support member; the upper support member having an aperture located therein, a wall surrounding the aperture, a plurality of protrusions on the wall; a table top having an upper surface and a bottom surface, a connecting ring extending outwardly from the bottom surface, the connecting ring being configured and sized to fictionally engage the protrusions on the wall surrounding the aperture; and a flower pot having a bottom wall and a side wall, the side wall being sized to fit within the aperture in the upper support member whereby the side wall of the flower pot will engage the protrusions on the wall surrounding the aperture.

The convertible flower pot support and table may be formed of any suitable material, with a preferred material being a molded plastics material. Such materials are well known in the art and need not be detailed herein. The unit may be molded in several parts and connected together by suitable means such as ultrasonic welding or alternatively, may be mechanically connected together to provide a more compact device for storage.

BRIEF DESCRIPTION OF THE DRAWINGS

Having thus generally described the invention, reference will be made to the accompanying drawings illustrating an embodiment thereof, in which:

FIG. 5 a side elevational view illustrating the convertible flower pot holder/garden table structure anchored into a ground surface and being used with its table top for serving as a table top supporting a bowl and glass both shown in phantom lines;

FIG. 6 is a bottom perspective view of the table top portion of a convertible flower pot holder/garden table structure; and FIG. 7 is a cross sectional exploded view along the line VII—VII of FIG. 5 showing the table top of FIG. 6 about to be mounted on the base.

DESCRIPTION OF THE PREFERRED EMBODIMENTS

Figure 1:
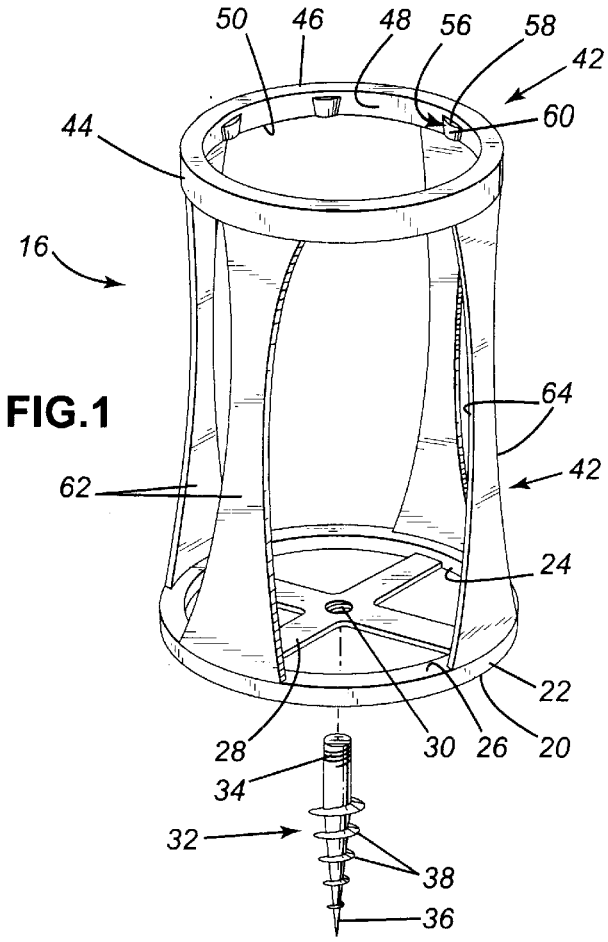
FIG. 1 is a perspective exploded view illustrating a base frame and an anchoring peg of a convertible flower pot/garden table structure in accordance with an embodiment of the present invention.
Figure 2:
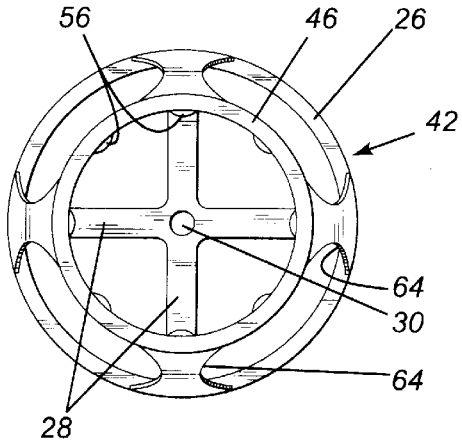
FIG. 2 is a top plan view illustrating the base frame shown in FIG. 1.
Figure 3:
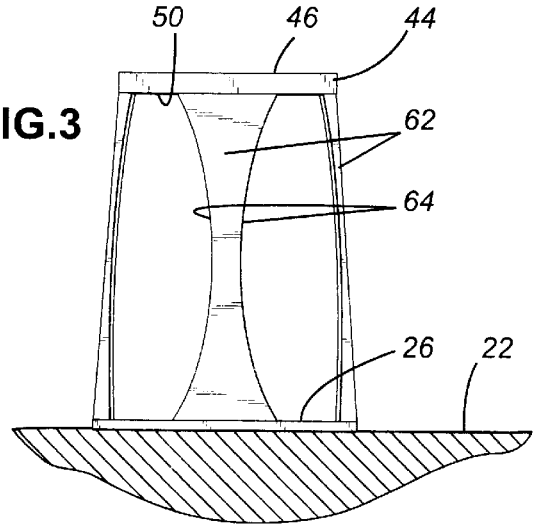
FIG. 3 is a side elevational view illustrating the base frame shown in FIGS. 1 and 2.
Figure 4:
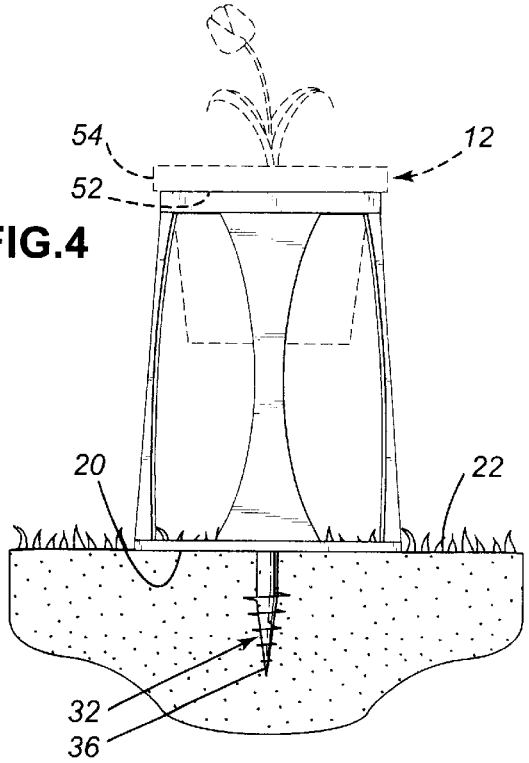
FIG. 4 is a side elevational view illustrating the base frame shown in FIGS. 1 through 3 anchored into a ground surface by its anchoring component and supporting a conventional flower pot, the conventional flower pot and flower planted therein being shown in phantom lines.

Turning initially to FIGS. 4 and 5, there is shown a convertible flower pot/garden table structure in accordance with an embodiment of the present invention being used respectively as a flower pot holder (FIG. 4) for supporting a conventional flower pot 12 which is shown in phantom lines and as a garden table (FIG. 5) for supporting articles such as a conventional bowl and glass combination 14 also shown in phantom lines. Whether in its flower pot holder or garden table configuration, device 10 uses a bottom frame 16 illustrated more specifically in FIGS. 1 through 3. Base frame 16 may be placed on a ground surface 22 such as a garden lawn or the like.

In the illustrated embodiment of the invention, base frame 16 comprises a base ring 20 having a generally annular configuration. Base ring 20, in turn, has an inner surface 24 and an upper surface 26. An anchoring plate 28 having an X-shaped configuration extends between inner surface 24 of base ring 20. Anchoring plate 28 is provided with a threaded anchoring aperture 30 extending substantially centrally therethrough. It will be understood that base ring 20 and anchoring plate 28 may have other configurations apart from that shown.

Anchoring aperture 30 is specifically adapted to threadably receive an anchoring component 32. Anchoring component 32 preferably takes the form of an anchoring peg having a threaded first end 34 for matingly connecting with threaded anchoring aperture 30 and a generally pointed tip 36 for facilitating its insertion into ground surface 22. An anchoring thread 38 preferably extends from the outer surface of the body of anchoring component 32 for further facilitating its insertion into ground surface 22 and increasing the efficiency of its anchoring function.

Bottom frame 16 further includes an upper support member 42 maintained in a stable vertically spaced relationship relative to ground abutting component 18 by four legs 62.

In the illustrated embodiment of the invention, upper support member 42 takes the form of a generally annular ring having a top surface 46, an inner surface 48 and a bottom surface 50. Top surface 46 preferably has a generally flat configuration for abuttingly contacting a bottom surface 52 of the rim 54 of a conventional flower pot 12.

Protrusions 56 extend integrally from inner surface 48 of upper support member 42. Each protrusion 56 has a protrusion top wall 58 which is spaced from the inner peripheral edge of top surface 46. Each protrusion 56 further has a generally arcuate convex inner side wall 60 tapering inwardly in a direction leading towards bottom surface 50 of upper support member 42. Protrusions 56 are adapted to facilitate accommodation of flower pots 12 having various sizes and configurations within a predetermined range. Furthermore, protrusions 56 are specifically designed so as to provide for ready mounting and dismounting of a table top. Protrusions 58 are preferably equally radially spaced apart from each other along inner surface 48.

Legs 62 are attached at one end thereof to bottom surface 50 of upper support member 42 and at a second end thereof to upper surface 26 of base ring 20. In one embodiment of the invention, base ring 20 is formed of a polymeric material and leg members 62 are suitably rigidly attached at their respective ends by conventional manufacturing methods such as ultrasonic welding. In an alternative embodiment, both bottom surface 50 and base ring surface 26 may be provided with attachment apertures formed therein (not shown). Similarly, the respective ends of legs 62 may be provided with connecting pins (not shown) for releasable snapping insertion within the corresponding connecting recesses. Such an embodiment provides the added advantages of allowing for disassembly of bottom frame 16 when not in use into three sub-sets of components namely base ring 22, upper support member 42 and a set of legs 62.

Each leg 62 has a pair of opposed leg side edges 64 with each leg side edge 64 having a generally concave configuration so as to give each leg 62 a substantially hourglass general configuration. Such a leg configuration provides both structural stability and an esthetically pleasing aspect. Furthermore, it optimizes leg room since it provides a relatively large distance between side edges 64 of adjacent legs 62 allowing for at least partial inclusion of the knee section of an intended user.

Referring now more specifically to FIGS. 5 through 7, there is shown a table top 70 designed to be used for converting the convertible flower pot holder/garden table into its table configuration. Table top 70 includes a top 72 preferably having a generally disk shaped configuration although it could take other configurations such as a square, rectangular, triangular or other suitable configurations. Top 72 has an upper surface 74 and a bottom surface 76. A connecting ring 78 extends outwardly and substantially perpendicularly from bottom surface 76. Connecting ring 78 in turn, has a connecting ring inner surface 80 and a connecting ring outer surface 82. A set of braces 84 having a generally X-shaped configuration extend between connecting ring inner surface 80. Connecting ring 78 is configured and sized so that its outer surface 82 may be fittingly inserted in frictional engagement with protrusions 56. Table top 70 is thus adapted to be readily and easily installed and removed to and from bottom frame 16.

The generally beveled configuration of protrusions 56 allow for accommodation of various shapes and configurations by providing frictional contact at various height levels of the support object.

It will be understood that the above described embodiment is for purposes of illustration only and that changes and modifications may be made thereto without departing from the spirit and scope of the invention.

I claim:

1. A convertible flower pot support and table comprising:

a base;

an upper support member;

at least one leg extending between said base and said upper support member;

said upper support member having an aperture located therein, a wall surrounding said aperture, a plurality of protrusions on said wall; and a table top having a planar upper surface and a bottom surface, a connecting ring extending downwardly from said bottom surface, said connecting ring being configured and sized to frictionally engage said wall surrounding said aperture to thereby retain said table top in position.

2. The convertible flower pot support and table of claim 1 wherein said base comprises an annular base ring having an anchoring plate connected thereto.

3. The convertible flower pot support and table of claim 2 wherein said anchoring plate includes a threaded anchoring aperture, an anchoring peg having one end screw threadably engageable with said anchoring aperture, a second end of said anchoring peg having threads formed thereon for anchoring to a ground.

4. The convertible flower pot support and table of claim 1 wherein said base and said upper support member are substantially circular in configuration.

5. The convertible flower pot support and table of claim 1 wherein said at least one leg comprises four legs extending between said base and said upper support member.

6. The convertible flower pot support and table of claim 1 wherein each of said protrusions having a generally arcuate convex wall tapering inwardly and downwardly.

7. The convertible flower pot support and table of claim 5 wherein each of said legs has a generally hourglass configuration.

8. In combination, a structure comprising:

a base;

an upper support member;

a plurality of legs extending between said base and said upper support member;

said upper support member having an aperture located therein, a wall surrounding said aperture, a plurality of protrusions on said wall;

a table top having an upper surface and a bottom surface, a connecting ring extending outwardly from said bottom surface, said connecting ring being configured and sized to frictionally engage said protrusions on said wall surrounding said aperture; and a flower pot having a bottom wall and a side wall, said side wall being sized to fit within said aperture in said upper support member whereby said side wall of said flower pot will engage said protrusions on said wall surrounding said aperture.

9. The combination of claim 8 wherein said plurality of legs extending between said base and said upper support member comprise four legs, each of said legs having a generally hourglass configuration.

10. The combination of claim 8 wherein said base comprises an annular base ring having an anchoring plate connected thereto.

11. The combination of claim 9 wherein said anchoring plate includes a threaded anchoring aperture, an anchoring peg having one end screw threadably engageable with said anchoring aperture, a second end of said anchoring peg having threads formed thereon for anchoring to a ground.

* * * * *